US005839342A

United States Patent [19]

Cope et al.

[11] Patent Number: 5,839,342

[45] Date of Patent: Nov. 24, 1998

[54] YARN CUTTER

[75] Inventors: Steven A. Cope; Dennis L. Frost, both of Newark, Del.; Ricky Wayne Oakley, Midlothian, Va.

[73] Assignee: E. I. du Pont de Nemours and Company, Wilmington, Del.

[21] Appl. No.: 662,893

[22] Filed: Jun. 12, 1996

Related U.S. Application Data

[60] Provisional application No. 60/000,669, Jun. 29, 1995.

[51] Int. Cl.[6] ..... B26D 1/08

[52] U.S. Cl. ..... 83/583; 83/588; 83/639.1; 83/950

[58] Field of Search ..... 83/582–583, 588, 83/639.1, 639.7, 649, 909, 949–950, 196, 198; 242/19

[56] References Cited

U.S. PATENT DOCUMENTS

| | | | |
|---|---|---|---|
| 1,139,572 | 5/1915 | Perry | 83/583 |
| 2,201,180 | 5/1940 | Jordan | 83/447 X |
| 2,816,608 | 12/1957 | Farmwald et al. | 83/558 X |
| 3,191,831 | 6/1965 | Bunting, Jr. et al. | 225/4 |
| 3,322,013 | 5/1967 | Felix | 83/588 X |
| 3,624,720 | 11/1971 | Laky . | |
| 3,640,160 | 2/1972 | Nelson et al. | 83/24 |
| 3,683,732 | 8/1972 | Juppet | 83/198 X |
| 3,793,919 | 2/1974 | Lefebvre | 83/583 X |
| 3,854,356 | 12/1974 | Okreglak | 83/513 X |
| 3,894,459 | 7/1975 | Deppe et al. | 83/567 |
| 4,078,736 | 3/1978 | Corl . | |
| 4,157,048 | 6/1979 | Lemmer . | |
| 4,527,455 | 7/1985 | Morax | 83/582 X |
| 4,531,555 | 7/1985 | Tatematsu et al. | 139/429 |
| 5,033,345 | 7/1991 | Schnitzer . | |
| 5,150,640 | 9/1992 | Schnitzer | 83/583 |
| 5,438,753 | 8/1995 | Stepan | 30/90.1 X |
| 5,669,424 | 9/1997 | Schiller et al. | 139/450 |

FOREIGN PATENT DOCUMENTS

| | | | |
|---|---|---|---|
| 769937 | 9/1934 | France . | |
| 1 553 712 | 10/1970 | Germany | 69/25 |
| 0107372 | 7/1982 | Japan | 83/100 |
| 695827 | 8/1953 | United Kingdom | 120/DIG. 2 X |
| 1 318 174 | 4/1971 | United Kingdom . | |

*Primary Examiner*—Rinaldi I. Rada
*Assistant Examiner*—Boyer Ashley

[57] ABSTRACT

A yarn cutting apparatus comprising a cutter body, piston and a cutting mechanism. The cutting body has a cylindrical bore extending from a first end to a second end and a body notch extending transversely from one side to the other side of the cutter body. The cutting mechanism comprises a first cutting element, having an element notch and a planar support surface and a planar cutting surface parallel with the support surface, slidably mounted in the cutter body to move within the cylindrical bore and a second cutting element resiliently mounted in the cutter body adjacent the body notch. The second cutting element has a cutting edge and a planar surface that is parallel with and in surface to surface contact with the planar surface of the first cutting element. The piston is slidably fitted into the bore and engages an end of the first cutting element adjacent the first end of the bore, while the opposite end of the end of the first cutting element is attached to a bearing element slidably fitted into the bore. The cutter body further includes a support attached adjacent to the body notch and opposite the second cutting element for engaging the planar support surface of the first cutting element to resist rotation of the first cutting element due to the urging of the second cutting element.

13 Claims, 2 Drawing Sheets

YARN CUTTER

This application claims the benefit of U.S. Provisional application Ser. No. 60/000,669, filed Jun. 29, 1995.

BACKGROUND OF THE INVENTION

In present day high speed spinning operations, yarn cutters must operate fast and flawlessly. Failure to complete a cut during yarn winding operations can result in huge yarn losses. The need for strong, durable, reliable cutters is especially great for tough and difficult to cut yarns, such as aramids. Each yarn line requires a cutter; and, as a result, many cutters are needed on a spinning machine where many yarn lines are being cut and restrung with each bobbin change. There is a need for a low cost cutter that is simple to operate and maintain.

U.S. Pat. No. 5,150,640, issued Sep. 29, 1992, is directed toward a cutter for aramid yarns and utilizes a pair of cutting elements which have line-to-surface contact therebetween. Although this cutter is very effective in cutting tough yarns, such as aramids, it requires considerable care in fabrication, assembly, and alignment of the parts. The line-to-surface contact between the cutting elements is subject to misalignment if the piston rotates slightly because of imprecise alignment or wear. With only slight misalignment, gaps are created that allow filaments to pass without being cut. Because the contact force is concentrated along the line edge of one element, wear on this edge is accelerated. The piston requires a close fit in the bore to achieve the required alignment; if yarn spinning fluids build up in the cutter body bore, or contact the piston seals and cause swelling, the speed of the piston is diminished, which decreases the reliability of the cut, and the piston may bind in the bore particularly on the return stroke when it is driven by a spring.

SUMMARY OF THE INVENTION

The present invention involves a yarn cutter with a cutting mechanism having a cutter body and cutting means with surface-to-surface contact between cutting elements and with the freedom to align one cutting surface to the other. Cutting elements are arranged for each alignment, low wear and high cutting reliability.

The yarn cutter of the present invention comprises a cutter body comprising; a bore therethrough extending from a first end to a second end of the cutter body, and a body notch extending transversely from one side of the cutter body through the bore to the other side of the cutter body, the body notch adapted to receive a yarn; a cutting means for cutting a yarn received in the body notch, comprising a first cutting element having an element notch therein, the cutting element having a planar support surface, a planar cutting surface parallel with the support surface, and a cutting edge at one side of the element notch, the cutting edge positioned adjacent to a side of the body notch adjacent the first end of said bore, a piston slideably fitted into the bore and engaging the end of the cutting element adjacent the first end of the bore and adapted to slide from the first end toward the second end of the bore, a bearing element slideable fitted into the bore and engaging the end of the cutting element opposite the first end of the bore, a second cutting element resiliently mounted in the cutter body adjacent the body notch, said second cutting element having a cutting edge and a planar surface that is in contact with the planar cutting surface of the first cutting element as the piston and first cutting element slide from the first end toward the second end of the bore, said second cutting element being urged toward said planar cutting surface and being free to align in surface-to-surface contact with the planar cutting surface of said first cutting element, and a support attached to the body adjacent to the body notch and opposite said second cutting element, said support slidably engaging the planar support surface of said first cutting element to thereby resist rotation of said first cutting element due to the urging of said second cutting element as the first cutting element moves from the first end toward the second end of the bore.

DETAILED DESCRIPTION OF THE INVENTION

Figure 1:
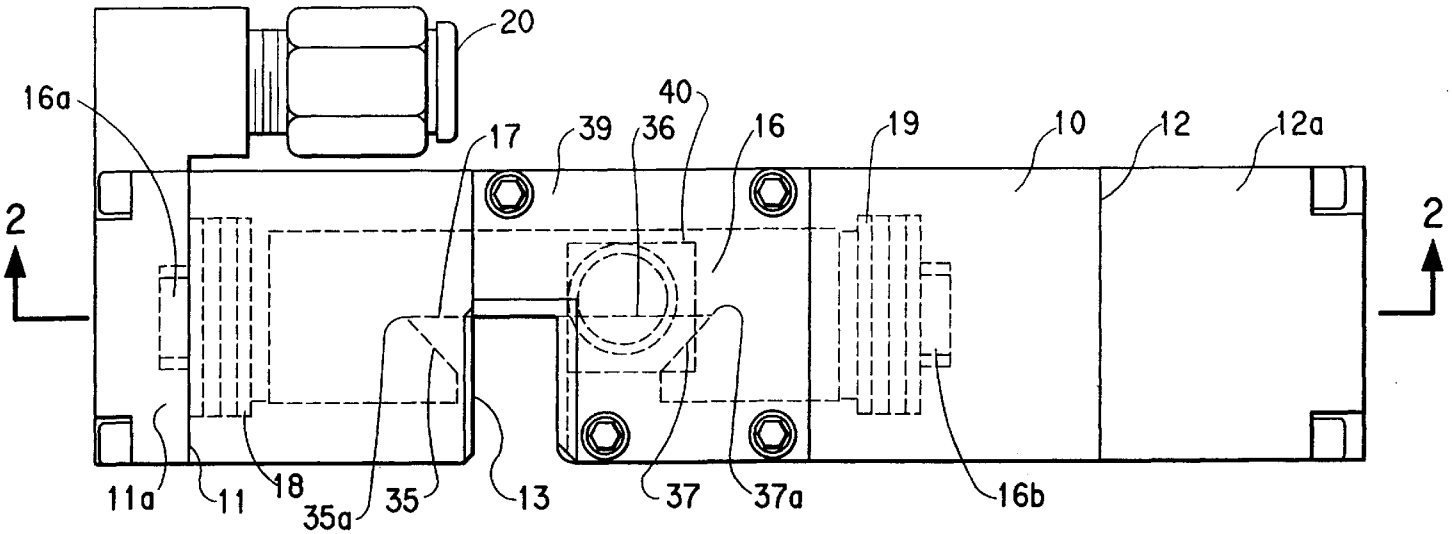
FIG. 1 is a top view of a cutter of this invention.
Figure 2:
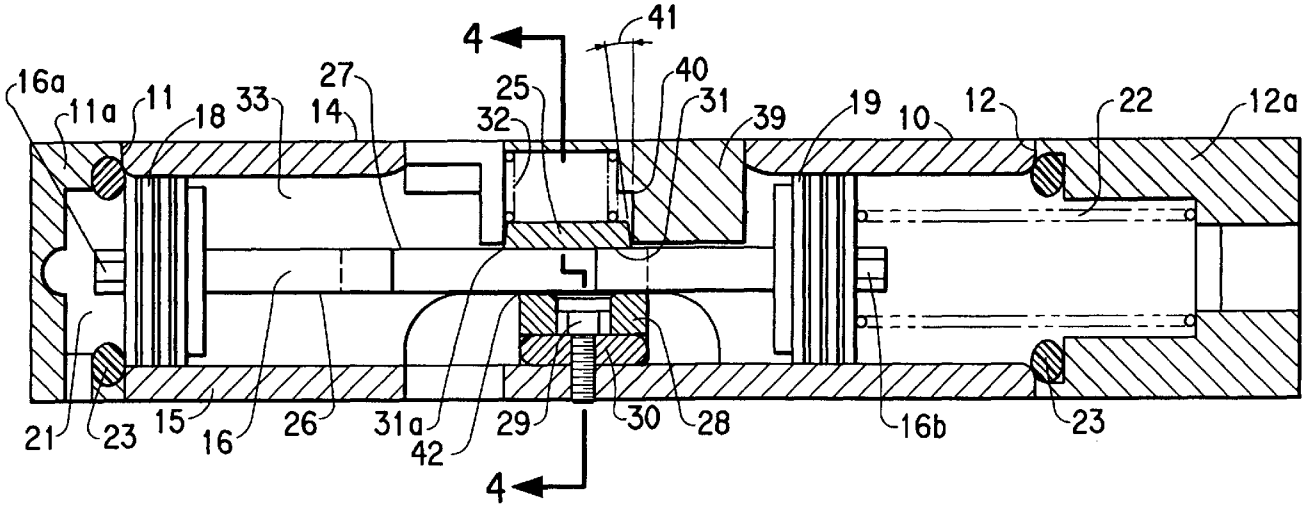
FIG. 2 is a sectional side view of the cutter of FIG. 1 at 2—2.

The yarn cutter of this invention has a simplified construction and an improved cutting means. FIGS. 1 and 2 depict a yarn cutter of this invention that has parts which are simple to fabricate and assemble, and are not subject to rapid wear and misalignment in use. FIG. 1 is a top view of the cutter and FIG. 2 is a side section view of the cutter of FIG. 1 at 2—2. Cutter body 10 has a cylindrical bore 33 therethrough from a first end 11 to a second end 12. Cap 11*a* covers end 11 and cap 12*a* covers end 12. Body notch 13 extends transversely through cutter body 10 from the top surface 14 to bottom surface 15 and is adapted for receiving a yarn to be cut. First cutting element 16 with element notch 17 is held, for reciprocal motion, in bore 33 by piston 18 adjacent first end 11 and bearing element 19 at second end 12. First cutting element 16 is joined with piston 18 by a protrusion 16*a* passing therethrough; and first cutting element 16 is joined with bearing element 19 by a protrusion 16*b* passing therethrough. When first cutting element 16 is located near first end 11, element notch 17 is coincident with body notch 13 for receiving a yarn to be cut. Notch end 34 of notch 17 includes cutting edge 35. Element notch 17 may be symmetrical (as shown) with respect to the protrusions 16*a* and 16*b* so element 16 may be switched end-for-end and a new cutting edge made available that is present on end 36 which has a cutting edge 37. It is preferred that notch 17 have a sharp angled corner 35*a* in end 34 and a sharp angled corner 37*a* in end 36. It is believed that the sharp angled corner acts to converge and compact the filaments of a yarn so they are more reliably cut than if a radiused corner is provided that may spread the yarn filaments.

Piston 18, on one end of first cutting element 16, and bearing element 19, on the other end, are slideably fitted into cylindrical bore 33 and are adapted to slide from first end 11 to second end 12 and back again. To effect the sliding, fluid pressure, as in the form of compressed air, can be provided at entrance 20 for introduction to chamber 21 (FIG. 2) to force the cutting assembly of piston 18, bearing element 19, and first cutting element 16 away from first end 11 and toward second end 12. The fluid pressure drives the cutting assembly to second end 12 against a biasing force such as spring 22 and to be stopped by cushion 23, such as an elastomeric ring. When the fluid pressure is removed, spring 22 drives the cutting assembly back to first end 11 to be stopped by another cushion 23. Other means can be used to drive the cutting assembly from the first end to the second end. As an example, cap 11*a* may have a hole provided therethrough to accept the moveable end of an electric solenoid actuator to bear against piston 18 and rapidly move the cutting assembly from first end 11 to second end 12.

Figure 3:
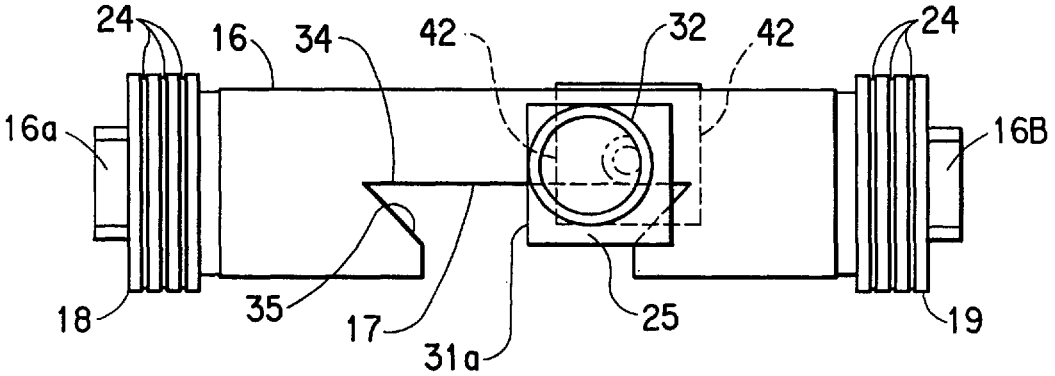
FIG. 3 is a top view of cutting elements, piston and bearing elements, and a support element of this invention, all as they relate to each other.
Figure 4:
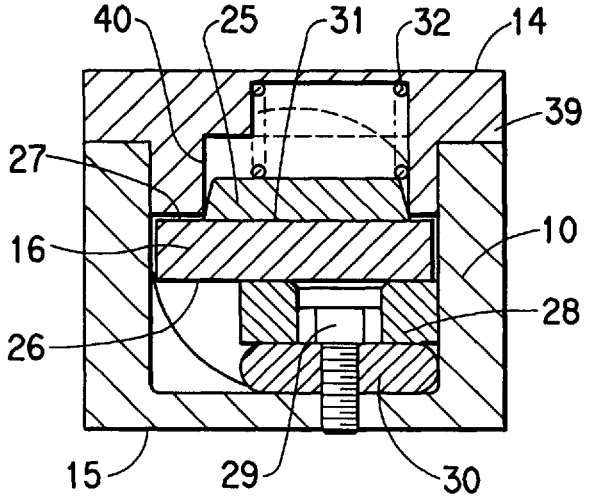
FIG. 4 is a sectional end view of the cutter of FIG. 2 at 4—4.

Referring now, primarily to FIGS. 3 and 4, piston 18 maintains a fluid seal and a sliding ability in the cylindrical bore by means of seals 24, such as a plurality of grooves cut into the outer surface of the cylindrical piston 18 that act as a labyrinth seal when the piston is a close fit in bore 33. Such a seal does not require a biased contact with the bore 33 so sliding friction between the piston and bore is reduced. Any slight leakage associated with this type of seal is insignificant in use. With this type of seal, there is no elastomeric seal element present that is subject to deterioration by contact with spinning fluids. In some cases where spinning fluids are not a concern, an elastomeric seal may be used to effect a fluid-tight seal. To further reduce friction between the piston and bore, the piston surface, or the entire piston can be a fluoropolymer. For convenience in fabrication and assembly, bearing element 19 is made the same as piston 18 so the parts may be interchangeable. This also permits exchanging spring 22 for fluid pressure if desired to return the cutting assembly to first end 11.

FIG. 3 is a plan view of only the cutting assembly and its relationship with other elements of the cutting means of this invention. FIG. 4 is a transverse sectional view of the cutter of FIG. 2 at 4—4. At section 4—4 of the cutter, the cylindrical bore within cutter body 10 has been milled in a rectangular shape to accommodate an anti-rotational planar support surface 28 for first cutting element 16 and a second cutting element 25. First cutting element 16 has a planar support surface 26 and a parallel planar cutting surface 27 and is prevented from rotating in the cylindrical bore by placement of support 28 in cutter body 10 against planar support surface 26. Support 28 is held in place by screw 29 and at the correct level by spacer 30. Support 28 slideably engages planar support surface 26, thus, preventing first cutting element 16 from rotating in the cylindrical bore due to any urging of second cutting element 25 against planar cutting surface 27.

Second cutting element 25 has flat cutting surface 31 which is biased against planar cutting surface 27 of first cutting element 16 by resilient biasing means 32, such as a coil spring. Second cutting element 25 slides with flat cutting surface 31 on parallel planar cutting surface 27 when the cutting assembly is reciprocated. Second cutting element 25 is mounted in a removeable top cover 39 of cutter body 10 and is positioned such that flat cutting surface 31 is urged toward planar cutting surface 27 to yield a surface-to-surface contact and cutting edge 31*a* is the leading edge or corner of flat cutting surface 31 in contact with planar cutting surface 27. Second cutting element 25 is free floating in that it is not fixed to cutter body 10; but held resiliently between cutter body 10 and first cutting element 16 by resilient means 32. As first cutting element 16 is reciprocated, second cutting element 25 slides over planar cutting surface 27 and across cutting edge 35 of element notch 17.

Cutting element 25 is contained in a cavity 40 in top cover 39, but is losely contained so the element can tilt until cutting surface 31 is flat against cutting surface 27. Since surface 31 overhangs notch 17 in element 16, spring 32 is offset away from notch 17; and it is also offset toward cutting edge 31*a* to counter the force of the yarn as it is cut which may tend to separate the cutting elements. This places the center of spring 32 in the upper left quadrant of element 25 as shown in FIG. 3. Cutting element 25 is preferably a commercial, square, cutting tool insert with tapered ground sides. Such inserts can be obtained from Micro 100, Inc. of Los Angeles, Calif. and are made of micro-grain carbide. It is preferred that the taper angle 41 be oriented as shown in FIG. 2, although inserts without tapered sides have also been found to work. A similar insert with a mounting hole in the center is preferred for support 28 since it is desirable that it be an inexpensive, hard, low wear surface. Support 28 is offset from notch 17 and is offset away from the cutting edge 31*a* so there is a clearance between edge 31*a* and edge 42 of support 28 for the cut end of the moving yarn.

The material for the first cutting element 16 should be a material which will slide readily against the second cutting element and support, and will withstand many cycles of reliable cutting. One material which is known to work well is C-2 grade tungsten carbide having a finish at the cutting edge that is finer than 20 microinches and is coated with chemical vapor deposition coatings of 2 microns of titanium carbide and further coated with 2 microns of titanium nitride. Another material which may work is alumina ceramic, one version of which is called Aremcolox, grade 502-1400, furnished by Aremco Products, Inc. in Ossining, N.Y., U.S.A. The alumina ceramic should also have a finish finer than 20 microinches. The second cutting element 25 and support 28 may also be coated with titanium nitride to provide longer wear and lower friction against element 16.

In operation, a yarn to be cut is received in body notch 13 and element notch 17, fluid pressure is introduced to chamber 21, forcing piston 18 to carry first cutting element 16 along the cylindrical bore and causing element notch 17 to pull the yarn against second cutting element 25. The yarn is cut by shearing action between edge 35 of cutting element 16 and edge 31*a* of element 25. The pressure is then vented from chamber 21 and the biasing means, such as spring 22, moves the cutting assembly to the left to reset it for the next cut.

The cutting action of the present invention is very efficient and effective because second cutting element 25 forms a surface-to-surface contact with first cutting element 16 and is biased against first cutting element 16 in a free-floating manner by a resilient means. The resilient means also presses first cutting element 16 against support element 28 to prevent rotation of element 16 in bore 33. Piston 18 and bearing element 19 act to laterally position element 16 in bore 33. The free floating capability of the second cutting element and preload bias between the two cutting elements is best achieved when the force center of the resilient means is in the quadrant of the second cutting element which both includes an edge that contacts the yarn during cutting, and is over cutting surface 27 of cutting element 16 and away from notch 17.

What is claimed is:

1. A yarn cutter comprising:

a cutter body having a top surface and a bottom surface and comprising:

a bore therethrough extending from a first end to a second end of the cutter body and;

a body notch extending transversely from the top surface of the cutter body through the bore to the bottom surface of the cutter body, the body notch adapted to receive a yarn;

a cutting means for cutting a yarn received in the body notch, comprising a first cutting element having an element notch therein, the cutting element having a planar support surface, a planar cutting surface parallel with the support surface, and a cutting edge at one side of the element notch, the cutting edge positioned adjacent to a side of the body notch adjacent the first end of said bore;

a piston slideably fitted into the bore and engaging an end of the cutting element adjacent the first end of the bore and adapted to slide from the first end toward the second end of the bore;

a bearing element slideable fitted into the bore and engaging an end of the cutting element opposite the first end of the bore;

a second cutting element resiliently mounted in the cutter body adjacent the body notch, said second cutting element having a cutting edge and a planar surface that is parallel with and in surface-to-surface contact with the planar cutting surface of the first cutting element as the piston and first cutting element slide from the first end toward the second end of the bore, said planar surface of said second cutting element being biased against said planar cutting surface of said first cutting element and being free to align in surface-to-surface contact with the planar cutting surface of said first cutting element;

a support attached to the body adjacent to the body notch and opposite said second cutting element, said support engaging the planar support surface of said first cutting element to thereby resist rotation of said first cutting element due to the urging of said second cutting element as the first cutting element moves from the first end toward the second end of the bore.

2. The cutter of claim 1 wherein the cutting edge at one side of the element notch has a sharp angled corner for compacting the yarn during cutting.

3. The cutter of claim 1 wherein the piston and bearing elements are made of a fluoropolymer.

4. The yarn cutter of claim 1, wherein the first cutting element is made from alumina ceramic.

5. The yarn cutter of claim 1, wherein the first cutting element is made from tungsten carbide and coated first with titanium carbide and then with titanium nitride.

6. The cutter of claim 1, further comprising a resilient biasing means for urging said second cutting element toward said planar cutting surface of said first cutting element.

7. The cutter of claim 6, wherein the resilient biasing means is a coil spring.

8. The cutter of claim 1, wherein said first cutting element includes a protrusion on each end with one protrusion engaging said piston and the opposite protrusion engaging said bearing element.

9. The cutter of claim 8, wherein said one protrusion passes through said piston and said opposite protrusion passes through said bearing element to thereby engage them.

10. The yarn cutter of claim 1, further comprising a means for directing fluid pressure from a source to the first end of the bore, thereby forcing the piston to travel from the first end toward the second end of the bore and passing the edge of the first cutting element attached to the piston past the edge of the second cutting element mounted in the cutter body, thereby cutting the yarn.

11. The cutter of claim 10 wherein the piston is sealed to the bore by an elastomeric seal.

12. The yarn cutter of claim 10, further comprising a spring biasing means in the cutter body at the second end of the bore, for urging the piston against the force of the fluid pressure.

13. The cutter of claim 10 wherein the piston has circumferential grooves to form a labyrinth seal with the bore to restrict fluid leakage between the piston and bore.

* * * * *